US012371300B2

(12) United States Patent
Haslacher

(10) Patent No.: US 12,371,300 B2
(45) Date of Patent: Jul. 29, 2025

(54) UNWINDING MANDREL FOR CONNECTING TO AN UNWINDING APPARATUS FOR UNWINDING ELONGATE MATERIALS

(71) Applicant: HASLACHER & HASLACHER IMMOBILIEN GMBH, Thalgau (AT)

(72) Inventor: Helmut Haslacher, Mondsee (AT)

(73) Assignee: HASLACHER & HASLACHER IMMOBILIEN GMBH, Thalgau (AT)

( * ) Notice: Subject to any disclaimer, the term of this patent is extended or adjusted under 35 U.S.C. 154(b) by 58 days.

(21) Appl. No.: 17/909,590

(22) PCT Filed: Mar. 5, 2021

(86) PCT No.: PCT/AT2021/060075
§ 371 (c)(1),
(2) Date: Sep. 6, 2022

(87) PCT Pub. No.: WO2021/174276
PCT Pub. Date: Sep. 10, 2021

(65) Prior Publication Data

US 2023/0139494 A1 May 4, 2023

(30) Foreign Application Priority Data

Mar. 6, 2020 (AT) ..... A 50184/2020

(51) Int. Cl.
*B65H 49/32* (2006.01)
*B65H 16/04* (2006.01)
(Continued)

(52) U.S. Cl.
CPC ..... *B65H 49/321* (2013.01); *B65H 16/04* (2013.01); *B65H 49/26* (2013.01); *B65H 49/28* (2013.01); *B65H 49/325* (2013.01)

(58) Field of Classification Search
CPC ..... B65H 18/02; B65H 18/04; B65H 49/26; B65H 49/28; B65H 49/321; B65H 49/00;
(Continued)

(56) References Cited

U.S. PATENT DOCUMENTS 2,562,650 A * 7/1951 Trunkhill ..... B65H 49/30 242/129
3,017,136 A * 1/1962 Noffke ..... B65H 49/30 242/129
(Continued)

FOREIGN PATENT DOCUMENTS

CN 201478740 U 5/2010
CN 202260366 U 5/2012
(Continued)

*Primary Examiner* — Anna M Momper
*Assistant Examiner* — Raveen J Dias
(74) *Attorney, Agent, or Firm* — Dykema Gossett PLLC

(57) ABSTRACT

Various aspects of the present disclosure are directed to an unwinding mandrel for connecting to an unwinding apparatus for unwinding elongate materials and/or an unwinding system. In one example embodiment, an unwinding mandrel is disclosed including: a main part positioned in the center of a bundle of elongated materials; a connecting portion detachably connecting the unwinding mandrel to the unwinding apparatus; and at least one movable body pivotably connected by at least one joint to the main part transversely to a main extension axis of the main part.

17 Claims, 6 Drawing Sheets

(51) Int. Cl.
*B65H 49/26* (2006.01)
*B65H 49/28* (2006.01)

(58) Field of Classification Search
CPC ..... B65H 49/18; B65H 49/20; B65H 49/205; B65H 49/325; B65H 75/22; B65H 75/2209; B65H 75/2218; B65H 75/2227; B65H 75/2236; B65H 75/24; B65H 75/242; B65H 75/2495
USPC .... 242/128, 129, 129.5, 130, 132, 131, 136, 242/138
See application file for complete search history.

(56) References Cited

U.S. PATENT DOCUMENTS

| | | | | | |
|---|---|---|---|---|---|
| 3,420,468 | A * | 1/1969 | Rhoades | B65H 49/26 | 242/141 |
| 4,944,472 | A * | 7/1990 | Stahl | B65H 49/30 | 242/129 |
| 6,367,725 | B1 * | 4/2002 | Goodwin | B65H 49/22 | 242/129 |
| 6,991,196 | B2 * | 1/2006 | Wheeler | B65H 49/22 | 242/129 |
| 7,677,490 | B2 * | 3/2010 | Smallwood | B65H 49/22 | 242/578 |
| 7,810,752 | B2 * | 10/2010 | Tippett | B65H 49/321 | 242/129 |
| 8,690,095 | B2 * | 4/2014 | Kim | B65H 75/245 | 242/532.5 |
| 9,611,123 | B1 * | 4/2017 | Martelli | B65H 49/28 | |
| 2006/0157611 | A1 * | 7/2006 | Tippett | B65H 49/22 | 242/597.5 |
| 2008/0142629 | A1 | 6/2008 | Smallwood | | |
| 2012/0211585 | A1 * | 8/2012 | Kim | B65H 49/36 | 242/597.1 |
| 2013/0126664 | A1 | 5/2013 | Hitz | | |
| 2018/0099834 | A1 * | 4/2018 | Madrid | B65H 75/02 | |
| 2021/0009379 | A1 * | 1/2021 | Smith | B65H 75/4465 | |

FOREIGN PATENT DOCUMENTS

| | | | | |
|---|---|---|---|---|
| CN | 202848742 | U | 4/2013 | |
| DE | 19741499 | A1 | 4/1999 | |
| DE | 10045361 | A1 | 7/2001 | |
| DE | 20106881 | U1 | 7/2001 | |
| DE | 202004018906 | U1 | 4/2005 | |
| DE | 102004008550 | A1 * | 9/2005 | B65H 16/00 |
| GB | 575842 | A | 3/1946 | |

* cited by examiner

UNWINDING MANDREL FOR CONNECTING TO AN UNWINDING APPARATUS FOR UNWINDING ELONGATE MATERIALS

CROSS-REFERENCE TO RELATED APPLICATION

This application is a national stage filing based upon International application No. PCT/AT2021/060075, filed 5 Mar. 2021, which claims the benefit of priority to Austria application No. A 50184/2020, filed 6 Mar. 2020.

BACKGROUND

The invention relates to an unwinding mandrel for connecting to an unwinding apparatus for unwinding elongate materials such as cables or pipes from a bundle, wherein the unwinding mandrel has a main part for arranging in the center of the bundle and a connecting portion for detachably connecting the unwinding mandrel to the unwinding apparatus.

Elongate materials such as cables, tapes or pipes are often present in rolls, i.e. rolled up as a bundle, for storage or transport. A core, for example a cable drum or a spool, can be used, or the material can be present without a core.

In order to roll up or unroll these bundles quickly and easily, unwinding apparatuses are often used which are arranged below the horizontally disposed bundle so that it can be rotated by pulling on one end of the material and thus unrolled. During unwinding, the bundle or a part of the unwinding apparatus is rotated and thus the material is wound up. An unwinding mandrel is arranged centrally in the bundle during this process and prevents the bundle from slipping on the device. In the context of the present invention, an unwinding mandrel is understood to be an elongate component that rotates along with the bundle or spool when the material is unwound or wound up.

If large bundles with cable drums are used, which can have a diameter of up to several meters, the unwinding apparatus is positioned at a suitable distance from the central opening of the standing bundle, which is then tipped over and tilted onto the unwinding apparatus. In this way, the unwinding mandrel is at least partially inserted into the central opening. In this way, the bundle does not roll away while it is being unrolled. However, this is difficult and time-consuming because the distance must be measured precisely in order to hit the unwinding mandrel exactly with the central opening.

If smaller bundles such as cable bundles without spools are used, they often slip very easily during unwinding on the unwinding apparatus, which can lead to snagging. Therefore, the cable can only be unwound slowly or must be readjusted repeatedly.

From US 2013/0126664 A or DE 100 45 361 A, holders are known which are suitable for carrying spools or the like in order to unwind material. Since no unwinding mandrels are provided, considerable friction always occurs, which makes unwinding considerably more difficult.

It is the object of the invention to avoid the problems described and to provide an unwinding mandrel that enables accelerated unwinding or rewinding.

SUMMARY OF THE INVENTION

According to the invention, this object is solved in that the unwinding mandrel has at least one, preferably four, movable bodies which are pivotably connected by at least one joint to the main part transversely to a main extension axis of the main part.

The term "detachable connection" refers to a connection that can be detached in an operationally non-destructive manner.

The bodies can be brought into the contact position during transport, which makes the unwinding mandrel as easy to transport as possible. If they are pivoted out of the contact position, they can be used to receive the bundle and thus enable improved unwinding and rewinding, as they can better stabilize the bundle.

Furthermore, the bodies can serve as a connection between the unwinding mandrel and the bundle, in particular the spool of the bundle, and better fix the unwinding apparatus to the bundle. This is particularly advantageous for bundles with a core, such as the cable drum. This enables the unwinding mandrel to be inserted and fixed in the standing bundle (i.e. cable drum) and to reinforce this connection with the bodies in a form-fitting and/or friction-fitting manner. Thus, the bundle together with the unwinding mandrel and the unwinding apparatus attached to it can be tilted so that the unwinding apparatus is arranged between the bundle and the substrate. This eliminates the need for complicated measuring and positioning of the unwinding apparatus.

Preferably, the body forms a support surface for supporting the bundle. The support surface is therefore substantially horizontal in the position of use. Essentially horizontal in this context means that the deviation from the horizontal plane is so small that the bundle can rest without slipping.

It is particularly advantageous if the bodies can be brought into a contact position in which they extend substantially along the main extension axis of the main part. This permits a particularly compact form of transport. Furthermore, it can be provided that the bodies in the contact position rest against the main part at least partially, preferably at least at their end opposite the joint.

The joint can be arranged in the area of the connecting section. This achieves unfolding of the bodies in the direction of the unwinding apparatus.

It is advantageous if at least one body is pretensioned in at least one position and preferably at least one spring exerts a force on the body in at least one direction.

In this way, the position of the body can be better fixed and unintentional movement of the same can be prevented.

In this respect, it is particularly advantageous if the body is pretensioned away from its contact position in the direction of a receiving position, wherein in the receiving position the ends of the brackets opposite the joint are further away from the main part than in the contact position. This allows the body to be self-clamping. Thus, even when inserted into the spool, the body can connect with the spool and secure the unwinding mandrel in the spool.

It is particularly preferably provided that the body is pretensioned in the direction of the receiving position from a transition point along its movement between the contact position and the receiving position, and that the body is preferably pretensioned before the transition point into the contact position. In this way, the body is held in its transport position and is not unintentionally unfolded during handling. If the body is moved to the transition point, it automatically moves to the receiving position. This facilitates and improves the positioning of the body.

For improved support of the bundle on the body, it can be provided that the body can be brought into a receiving position in which it extends substantially transversely to the main extension axis.

In an embodiment that is easy to produce, it is provided that the movable body is designed as a bracket. A bracket means a shaped piece with a substantially constant profile, which has at least two bracket parts that connect the joint to the end of the body opposite the joint. The bracket is preferably made of a metal such as steel or aluminum and particularly preferably has a constant profile.

To enable the bundle to connect better with the body, it may preferably be provided that at least one body has a termination at its end opposite the joint, which termination faces in the direction of the main extension axis in the contact position. Thus, the terminations result in an elevation with respect to the longitudinal axis of the bodies. The end prevents part of the bundle from slipping over the body.

In this context, the end can be formed by a part formed from the body. This is particularly simple and therefore inexpensive to manufacture, especially if the body is designed as a bracket.

It can also be advantageous if the closure has a molded part applied to the end of the body. This molded part can, for example, be a non-slip plastic or rubber coating.

It may preferably be provided that the body is of telescopic design, preferably along its main extension. This allows the length of the body to be adjusted depending on the size of the bundle.

Furthermore, it may be provided that at least one body has a termination at its end opposite the joint, and that the termination is of telescopic design, preferably in the contact position in the direction of the main extension axis.

For better accommodation of the bundle in the receiving position, the body can have a support surface for supporting the bundle, which preferably faces towards the main part in the contact position.

To be more usable for bundles of different sizes, at least two bodies may be provided and the bodies may have at least partially different lengths.

Preferably, at least the main part is at least partially made of plastic. This makes it possible to achieve a low weight and a robust design.

The main part is preferably of telescopic design, particularly preferably along the main extension axis. For this purpose, a telescopic body of the main part can have a locking mechanism for fixing at least one position on the main part, and the locking mechanism can preferably be locked by a snap lock after extraction from the main part.

The connecting section may have a snap connector for positive locking with the unwinding apparatus, and the connection may be releasable by a pushbutton of the unwinding mandrel. A snap connector or a snap lock is an element for positive locking of components to one another, in that parts to be joined are hooked together when a certain position is reached and can be brought out of this position again by pressure on a part to be joined against a pretension.

The invention also includes an unwinding system having an unwinding apparatus for unwinding elongate materials such as cables or pipes from a bundle, having a base plate for standing on a base.

According to the invention, the unwinding system has at least one unwinding mandrel of the type described above. The unwinding mandrel is preferably rotatably mounted relative to the base plate.

In a preferred embodiment variant of the invention, a turntable rotatable about an axis of rotation is mounted on the base plate for accommodating the bundle of elongate material. In this case, the unwinding apparatus can optionally be used without the unwinding mandrel of the type described above, for example by placing a bundle on the turntable, or by placing a loose bundle on the movable bodies of the unwinding mandrel mounted on the turntable.

For easier handling, it is preferably provided that the unwinding apparatus has a connector for non-destructively detachable connection to the connecting section of the unwinding mandrel.

Furthermore, the turntable can be rotationally connected to the base plate centrally, preferably along the axis of rotation.

The turntable can be rotatably connected to the base plate via preferably horizontally arranged bearings.

The base plate can have a receptacle for various additional devices, preferably length measuring devices for the elongate material.

The bodies may extend at least partially beyond the turntable in the receiving position.

According to the invention, it is possible for the unwinding mandrel to be attached to the base plate without a turntable. In this case, only a pivot bearing is provided to ensure the rotatability of the unwinding mandrel. Such an embodiment can be designed in particular as an extension of an unwinding apparatus which has a turntable with an unwinding mandrel which can be fastened thereon and, next to it, one or more pivot bearings for accommodating further unwinding mandrels. It is then possible to simultaneously unwind several wires, each of which is on a bundle.

BRIEF DESCRIPTION OF THE DRAWING

In the following, the present invention will be explained in more detail with reference to the embodiment variants shown in the figures, wherein.

DETAILED DESCRIPTION

Figure 1:
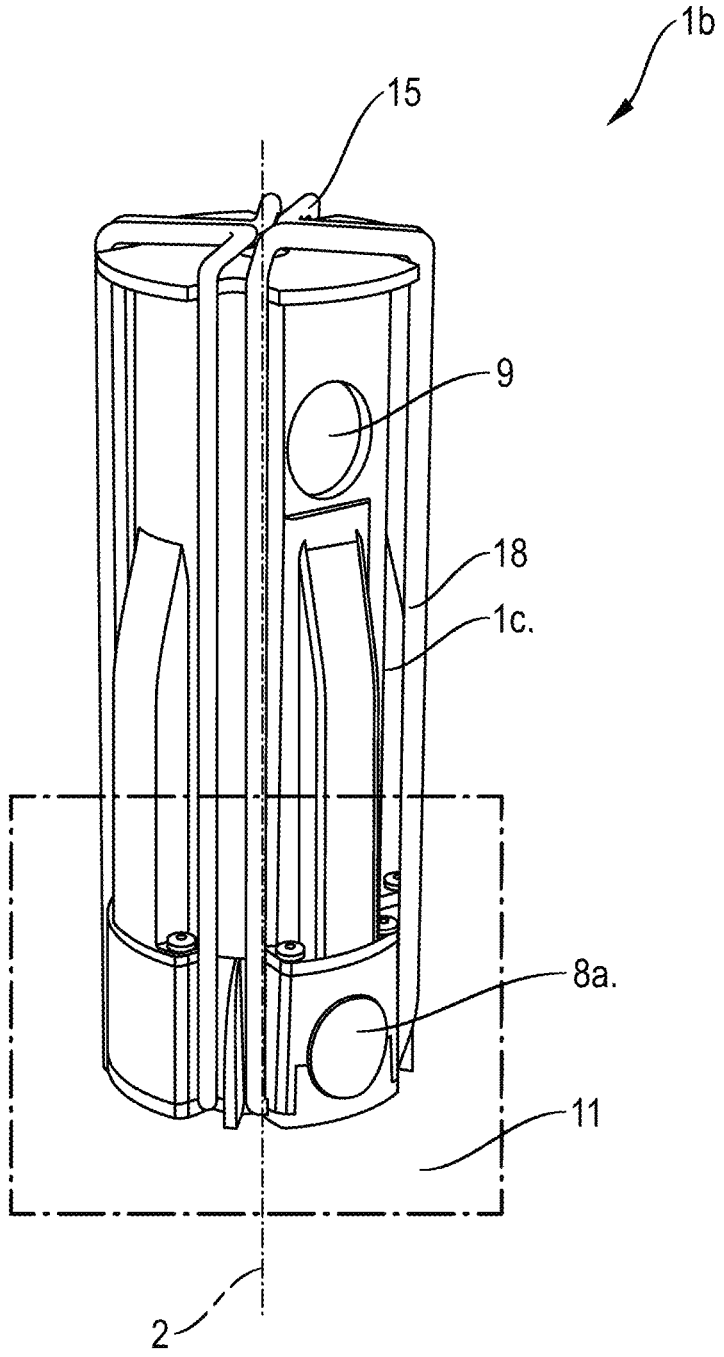
FIG. 1 shows a first embodiment of an unwinding mandrel according to the invention in a side view in a contact position.

In FIGS. 1 to 4, a first embodiment of an unwinding mandrel 1*b* is shown, which has an elongate, substantially circular main part 1*c* extending along a main extension axis 2. A connecting portion 11 is arranged at one end, which has a connecting surface normal to the main extension axis 2 and a receiving opening for connecting to an unwinding device 1*b* and receiving a pivot pin 3 of the unwinding device 1*b*. Thus, the pivot pin 3 also acts as a connector. When the pivot pin 3 is inserted, a positive connection is made by a snap connection which can be released by pressing the pushbutton 8 against a pretension of an elastic spring element.

In the region of the connecting section 11, a total of four bodies 18 are connected via one joint each, which are designed as integral brackets. All brackets are of the same design and are arranged radially symmetrically around the main extension axis 2. The joints allow pivoting about axes normal to the main extension axis 2. The respective opposite pivot axes of the joints are parallel.

Each body 18 is bent into shape from a single piece of steel rod and has a substantially constant round profile. At the end opposite the joint, each body 18 has a termination 15 which is triangular in shape and normal to its main extension.

Figure 2:
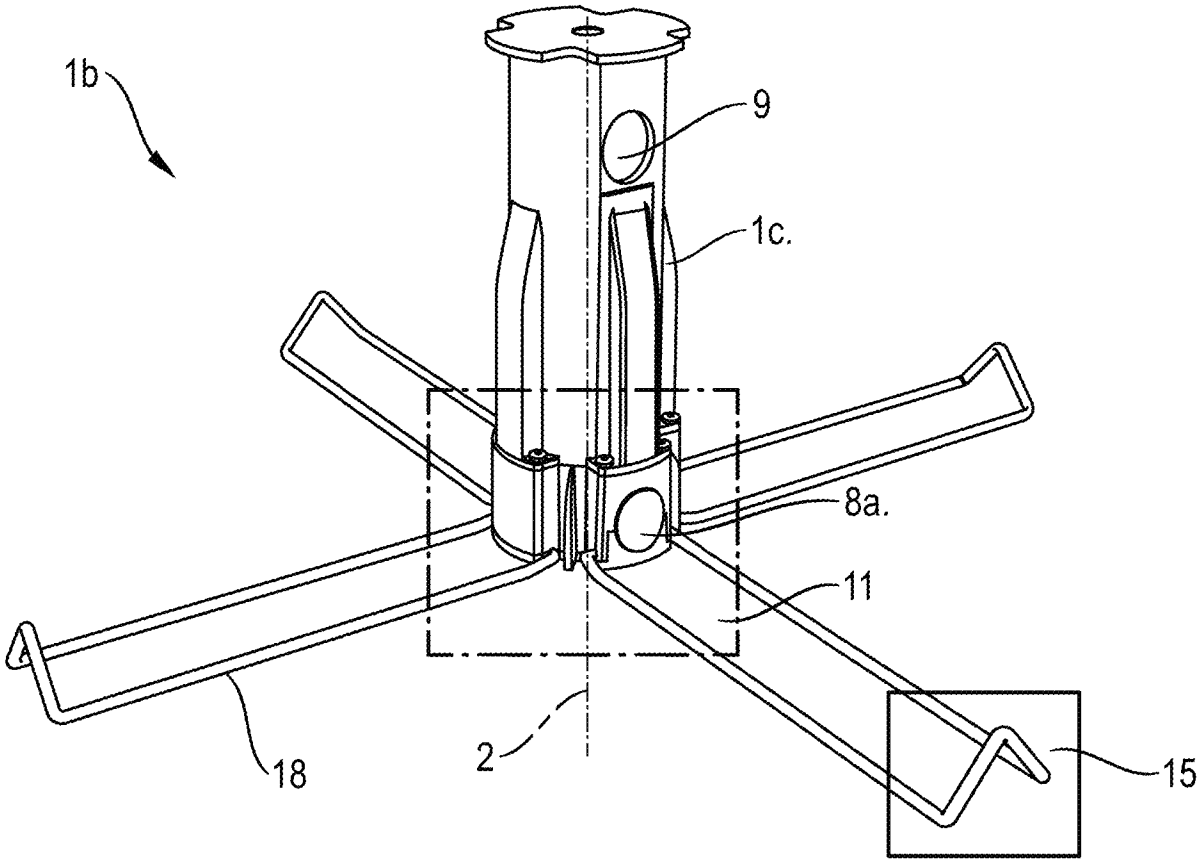
FIG. 2 shows the first embodiment in a receiving position.
Figure 3:
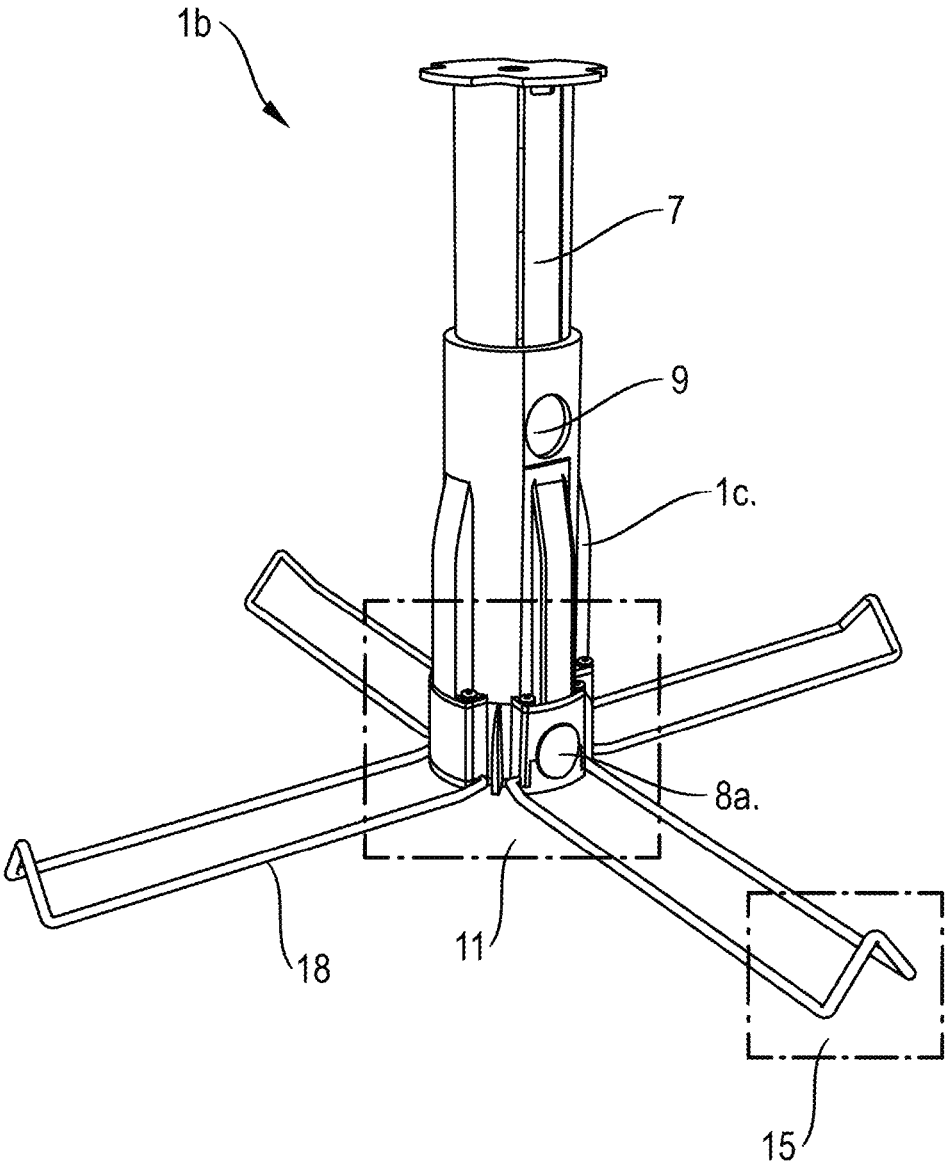
FIG. 3 shows the first embodiment in a receiving position with the telescope body extended.
Figure 4:
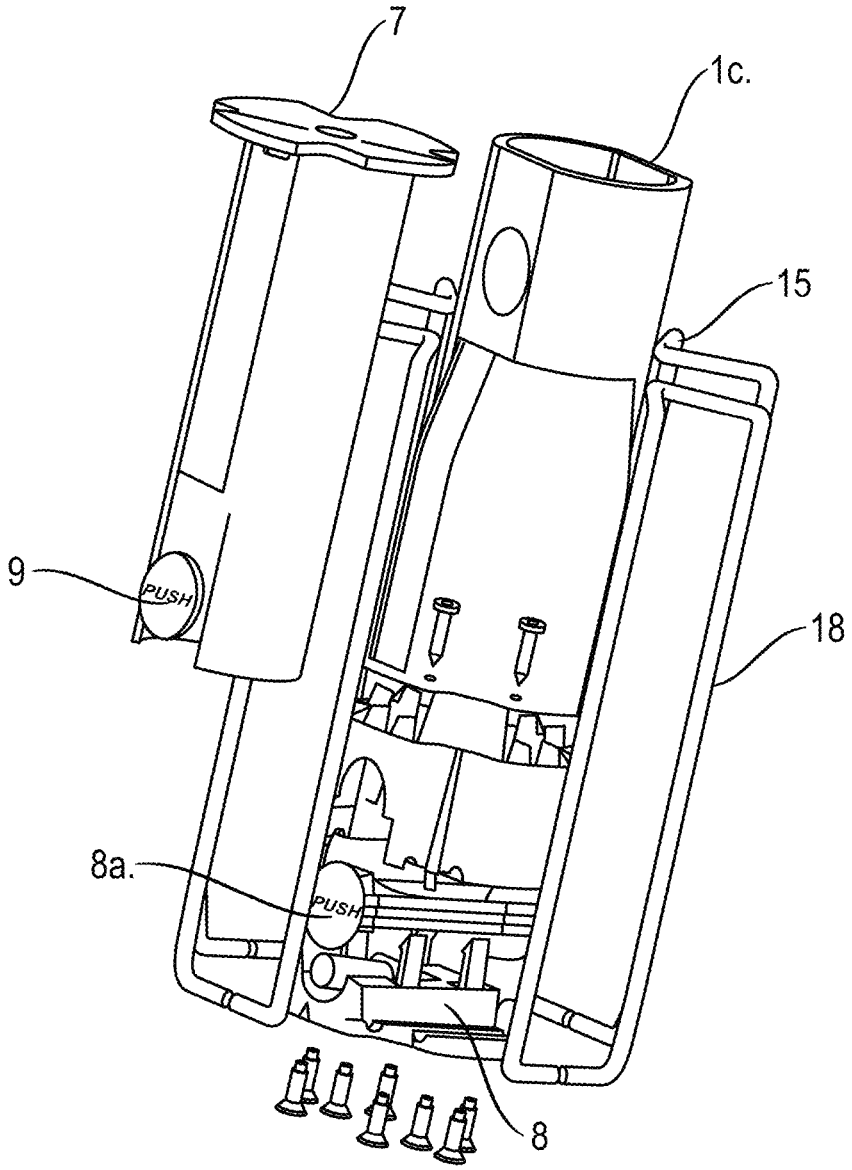
FIG. 4 shows an exploded view of the first embodiment.

The main part 1*c* is made of plastic and has a telescopic body 7 inserted in the end opposite the joint. This can be brought from a folded position as shown in FIG. 1 or 2 by pulling it out into an unfolded position (as shown in FIGS. 3 and 4), in which a snap lock 9 fixes the position of the telescopic body 7 in relation to the rest of the main part 1*c*. This can be released by a further pushbutton 8*a* as in the case of the snap connection.

The bodies 18 are shown in FIGS. 1 and 2 in a contact position. Here, the bodies 18 lie parallel to the main extension axis 2 and against the main part 1*c*.

When the bodies 18 are pivoted, the terminations 15 move away from the main extension axis 2. The pivoting of the bodies 18 is preferably limited to a maximum angle starting from the contact position, particularly preferably a maximum of 180° and most preferably 90°.

In the receiving position shown in FIG. 3 and FIG. 4, the bodies 18 are disposed normally to the main extension axis 2 and thus form receiving surfaces on which a bundle can be received. The terminations 15 face upwards and can prevent slipping off the edge areas of the bundle.

Figure 5:
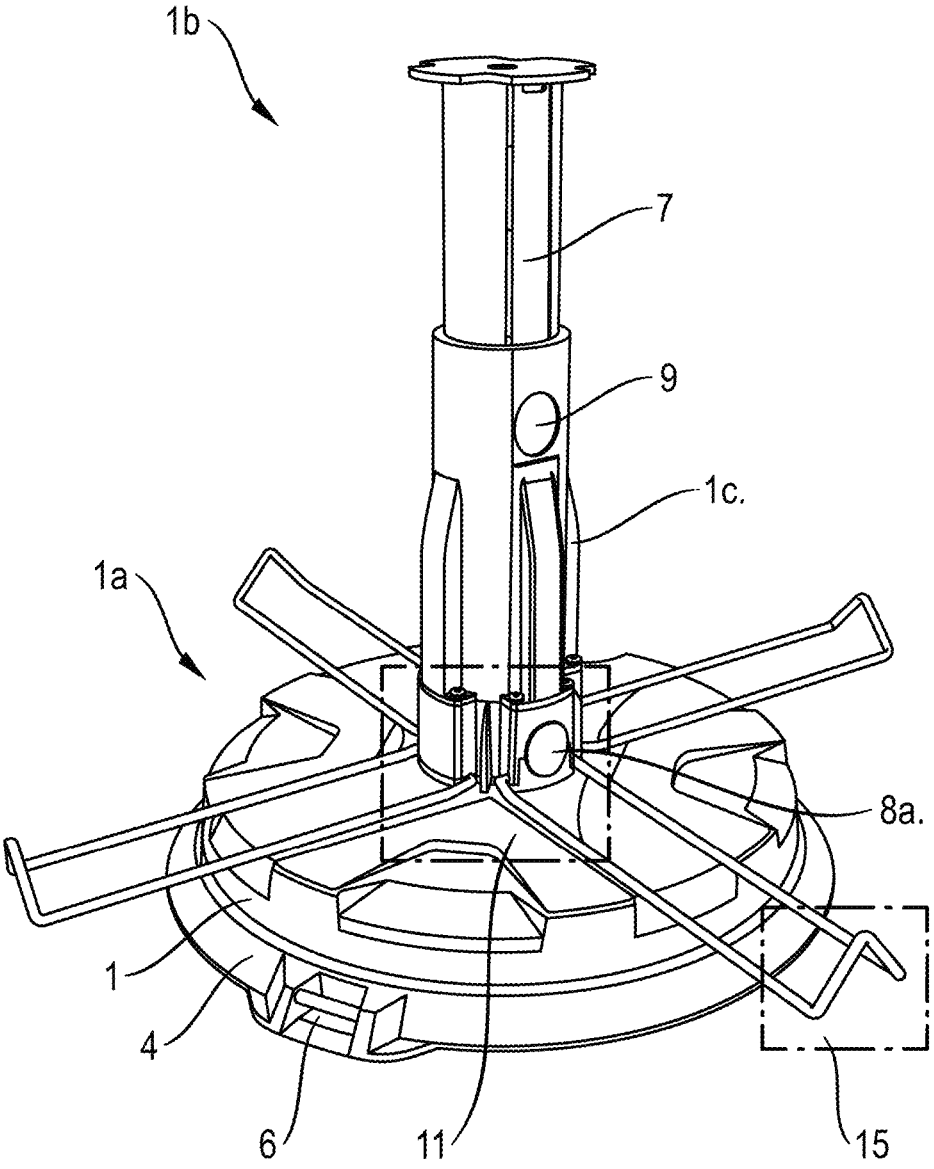
FIG. 5 shows an unwinding system according to the invention in a second embodiment in a receiving position in a view from the side.
Figure 6:
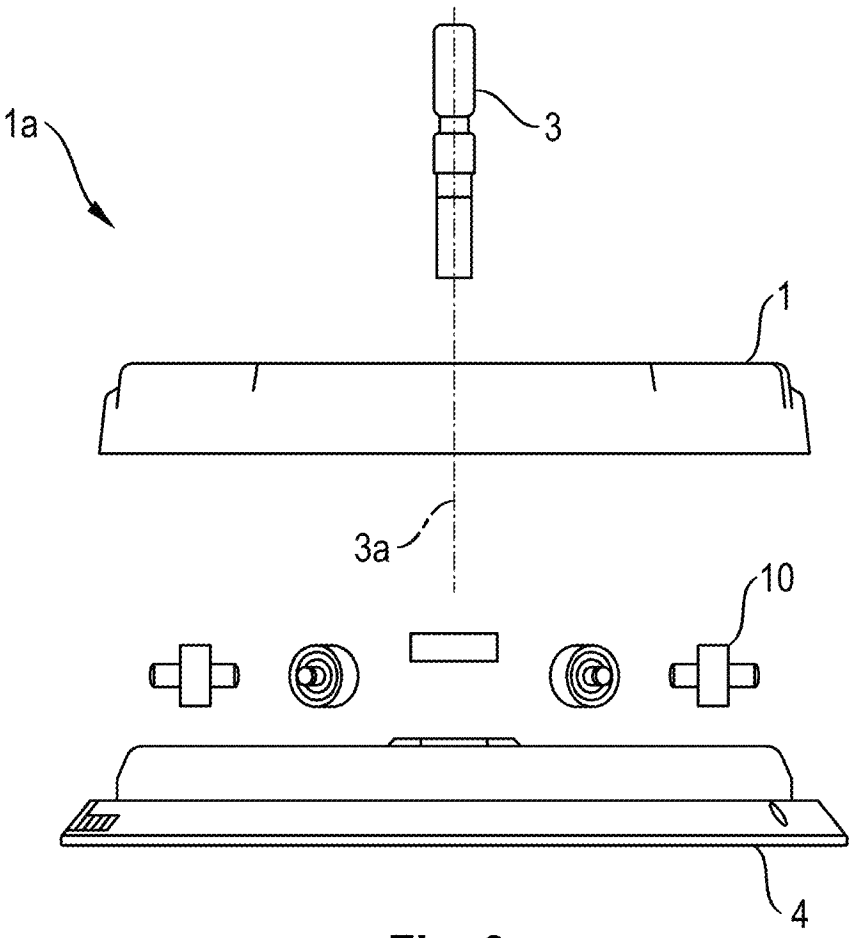
FIG. 6 shows an exploded view of an unwinding apparatus of the second embodiment.

FIG. 5 shows an unwinding apparatus 1*a* on which an unwinding mandrel 1*b* according to the invention is connected ready for operation. In this unwinding system, the bodies 18 project above a turntable 1 of the unwinding apparatus 1*a*. The bodies 18 are located on the turntable 1, and the main extension axis 1*c* is coaxial with the pivot pin 3 and the axis of rotation 3*a* which connects the turntable 1 to a base plate 4. In other embodiments, the turntable 1 and the base plate 4 can also be designed differently, for example not as continuous plates but only as strips or rod elements.

Turntable 1 and base plate 4 can be rotated against each other via the axis of rotation 3*a* and are also supported by bearings 10 in the form of plastic rollers.

The base plate 4 has a receptacle 6 to which, for example, a length measuring device for measuring the length of the unrolled material can be passed.

The invention claimed is:

1. An unwinding system, comprising:

an unwinding apparatus for unwinding elongate materials from a bundle, having a base plate for standing on a base, at least one unwinding mandrel for connecting to the unwinding apparatus, wherein the unwinding mandrel includes:

a main part configured to be arranged in a center of the bundle, a connecting portion configured and arranged to detachably connect the unwinding mandrel to the unwinding apparatus, a connector configured and arranged to releasably couple the unwinding apparatus to the connecting portion of the unwinding mandrel, and at least one movable body which is pivotably connected by at least one joint to the main part transversely to a main extension axis of the main part; and a turntable mounted on the base plate, the turntable being part of the unwinding apparatus and configured and arranged to rotate about an axis of rotation and to accommodate the bundle of elongate material.

2. The unwinding system of claim 1, wherein the at least one moveable body of the unwinding mandrel forms a support surface configured and arranged to support and carry the bundle.

3. The unwinding system of claim 1, wherein the at least one movable body is configured and arranged to be brought into a contact position in which it extends substantially along the main extension axis of the main part.

4. The unwinding system of claim 3, wherein the at least one movable body in the contact position rests at least partially against the main part.

5. The unwinding system of claim 1, wherein the at least one moveable body is pretensioned into at least one position.

6. The unwinding system according to claim 5, wherein the at least one moveable body is configured and arranged to be pretensioned away from its contact position towards a receiving position, wherein in the receiving position, ends of brackets opposite the at least one joint are further away from the main part than in the contact position.

7. The unwinding system according to claim 6, wherein the at least one moveable body is configured and arranged to be pretensioned from a transition point along its movement between the contact position and the receiving position in the direction of the receiving position.

8. The unwinding system according to claim 1, wherein the at least one moveable body has a termination at its end opposite the at least one joint, and wherein the termination faces in the direction of the main extension axis in a contact position.

9. The unwinding system according to claim 1, wherein the at least one moveable body has a termination at its end opposite the at least one joint, and in that the termination is telescopic.

10. The unwinding mandrel according to claim 1, wherein the at least one moveable body has a support surface configured and arranged for supporting the bundle.

11. The unwinding system according to claim 1, wherein the main part is of a telescopic design.

12. The unwinding system according to claim 11, wherein a telescopic body of the main part has a locking mechanism for fixing the telescopic body to the main part in at least one position and the locking mechanism is preferably lockable by a snap lock after extraction from the main part.

13. The unwinding system according to claim 1, wherein the connecting portion has a snap connector configured and arranged for positive connection to the unwinding apparatus.

14. The unwinding system according to claim 1, wherein the at least one unwinding mandrel is rotatably mounted relative to the base plate.

15. The unwinding system according to claim 1, wherein the turntable is rotationally connected to the base plate centrally.

16. The unwinding system according to claim 1, wherein the turntable is rotatably connected to the base plate.

17. The unwinding system according to claim 1, wherein the at least one moveable body of the unwinding mandrel extends at least partially beyond the turntable in a receiving position.

* * * * *